US005698811A

United States Patent [19]

Pfersmann

[11] Patent Number: 5,698,811

[45] Date of Patent: Dec. 16, 1997

[54] IGNITING UNIT FOR A PROPELLANT CHARGE

[75] Inventor: Axel Pfersmann, Lauf, Germany

[73] Assignee: Diehl GmbH & Co., Nürnberg, Germany

[21] Appl. No.: 642,439

[22] Filed: May 3, 1996

[30] Foreign Application Priority Data

Feb. 9, 1996 [DE] Germany ..... 196 04 655.6

[51] Int. Cl.[6] ..... F42C 19/08

[52] U.S. Cl. ..... 102/202; 102/204; 102/282; 102/380; 102/470

[58] Field of Search ..... 102/202, 204, 102/205, 282, 380, 430, 431, 439, 469, 470, 700; 60/256

[56] References Cited

U.S. PATENT DOCUMENTS

| | | | |
|---|---|---|---|
| 4,671,179 | 6/1987 | Synofzik et al. | 102/430 |
| 4,763,577 | 8/1988 | Romer et al. | 102/431 |
| 4,864,932 | 9/1989 | Reinelt et al. | 102/282 |
| 5,269,224 | 12/1993 | Gonzales et al. | 102/288 |

FOREIGN PATENT DOCUMENTS

| | | | |
|---|---|---|---|
| 0 304 099 | 2/1989 | European Pat. Off. . | |
| 0 304 100 | 2/1989 | European Pat. Off. . | |
| 2559255 | 8/1985 | France | 102/202 |
| 3446315 | 6/1986 | Germany | 102/202 |
| 42 23 735 | 1/1994 | Germany . | |
| 4198695 | 7/1992 | Japan | 102/439 |
| 5105572 | 4/1993 | Japan | 102/431 |
| 2160625 | 12/1985 | United Kingdom | 102/202 |

OTHER PUBLICATIONS

Armada International, Apr. 1995, "Neue Artilleriemunition" pp. 32–40.

*Primary Examiner*—Harold J. Tudor
*Attorney, Agent, or Firm*—Scully, Scott, Murphy & Presser

[57] ABSTRACT

An igniting unit for a propellent charge, including a central perforated flame guiding tube having propellant rods which are oriented in an axial direction arranged on the outer surface thereof. On the inner surface of the flame guiding tube and on the casing surface of the propellant rods, however, not on the end surfaces of the latter, there is provided an igniting coating, and in which the igniting coating which is provided on the inner surface of the flame guiding tube is enhanced by an igniting powder strip which is oriented to extend in an axial direction.

9 Claims, 2 Drawing Sheets

IGNITING UNIT FOR A PROPELLANT CHARGE

BACKGROUND OF THE INVENTION

1. Field of the Invention

The present invention relates to an igniting unit for a propellent charge, including a central perforated flame guiding tube having propellant rods which are oriented in an axial direction arranged on the outer surface thereof.

2. Discussion of the Prior Art

An igniting unit of the foregoing type is described in German Patent Publication No. 29 508 229. In that instance, the propellent charge rods are formed from roller shaped powder members which are constituted of pellets, and which possess a coating constituted of an igniting mixture.

An igniting unit for a propellent charge or, respectively, a propellent charge possessing an igniting unit is also known from the disclosure of German Patent Publication No. 42 23 735 A1. In that particular case, the central perforated flame guiding tube is encompassed by a low-pressure tube, whereby the interspace which is present between low-pressure tube and the flame guiding tube is filled with pellets which are coated with an igniting mixture. The low-pressure tube, in that case, is preferably formed from a contractable hose which fully encompasses on the exterior and at the end surfaces the aforementioned propellent charge located adjacent to the flame guiding tube, and which propellent charge is constituted from pellets coated with the igniting mixture. Towards the interior, the coated pellets are bounded by the flame guiding tube.

Propellent charges of the above-mentioned type for the formation of modular propellant systems are represented, for example, in the publication DE-Z "Armada International 4/1995," Page 39; and are described in the associated journal article under the title "Neue Artilleriemunition" (New Artillery Amunition), Pages 32 et seq.

A propellent charge with a number of densely and parallel packed propellant rods, each of which possesses at least one elongate channel, is known from the disclosure of European Patent Publication No. EP 0 304 100 B1. A similar propellent charge with adjacently located and mutually parallel oriented propellant rods is also known from the disclosure of German Patent Publication No. 0 304 099 B1.

SUMMARY OF THE INVENTION

Accordingly, it is an object of the present invention to provide an igniting unit of the above-mentioned type which, in particular, at a modular arrangement of a plurality of applicable propellent charges, further more uniformly distributes the igniting thereof; in effect, improves upon the uniformity in the igniting of these propellent charges.

The foregoing object is attained for an igniting unit of the above-mentioned type in that on the inner surface of the flame guiding tube and on the casing surface of the propellant rods, however, not on the end surfaces of the latter, there is provided an igniting coating, and in which the igniting coating which is provided on the inner surface of the flame guiding tube is enhanced or reinforced by an igniting powder strip which is oriented to extend in an axial direction.

Additional embodiments and modifications of the inventive igniting unit for propellants may be readily ascertained from the following detailed description.

The inventive igniting unit evidences the advantage that through the intermediary thereof, there is facilitated a uniform igniting or triggering of the applicable propellent charge, as well as a uniform igniting of an applicable number of propellent charges which are combined into a modular propellant system.

BRIEF DESCRIPTION OF THE DRAWINGS

Further details, features and advantages may now be more readily ascertained from the following detailed description of an embodiment of the inventive igniting unit for propellants as schematically represented in the drawings, as well as a schematically illustrated exemplary embodiment of a propellent charge including such an igniting unit which is assembled into a modular construction; taken in conjunction with the accompanying drawings; in which.

DETAILED DESCRIPTION OF PREFERRED EMBODIMENTS

Figure 1:
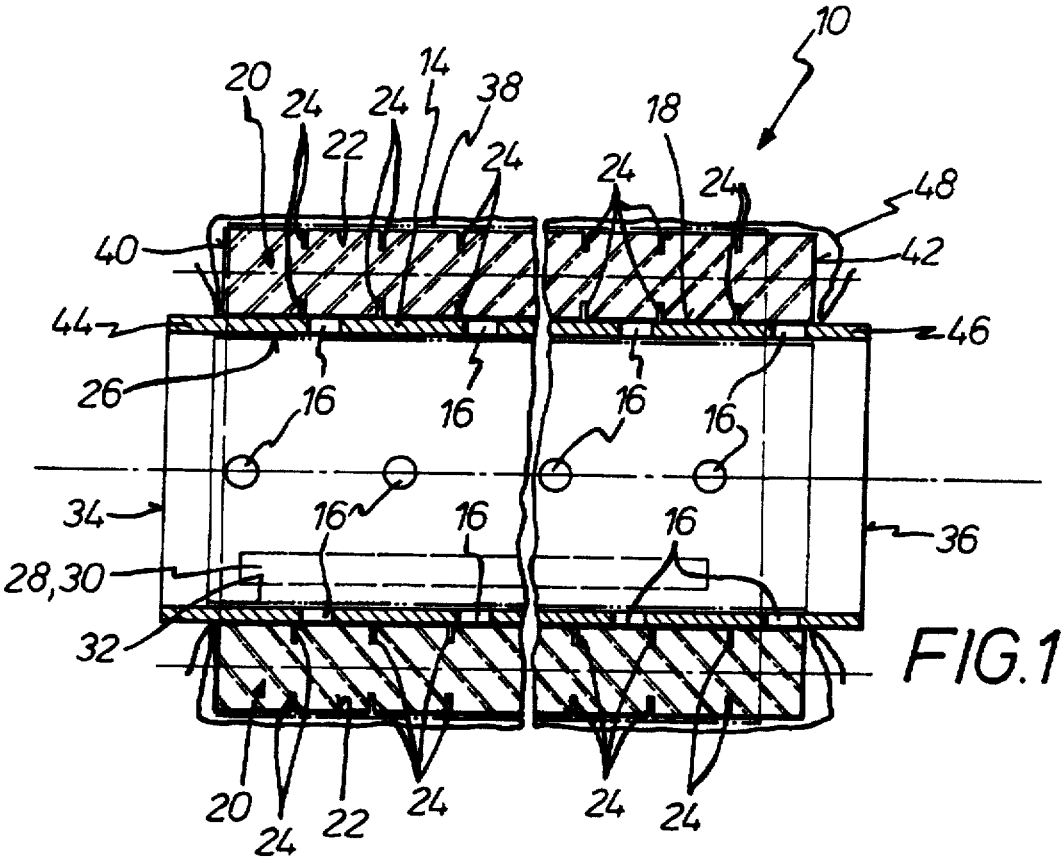
FIG. 1 illustrates a longitudinal sectional view through a shortened representation of an embodiment of the igniting unit.
Figure 2:
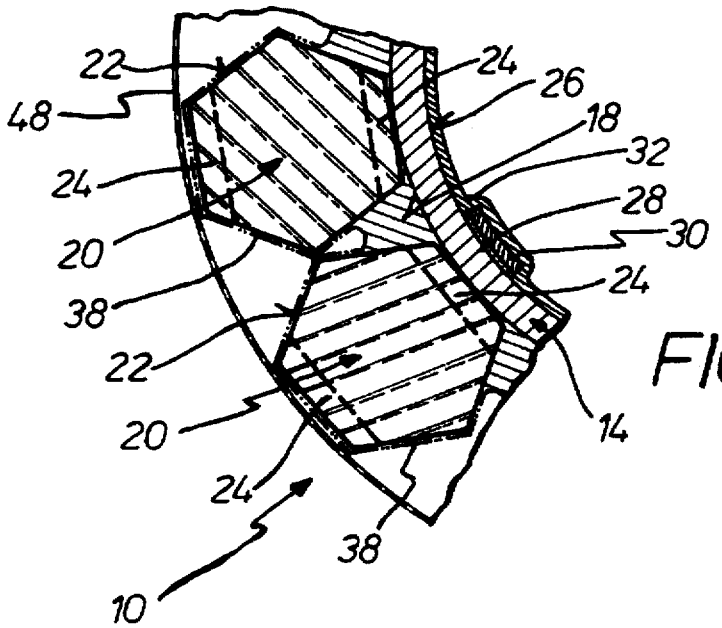
FIG. 2 illustrates, on an enlarged scale, a sectional view taken along Line II—II in FIG. 1, in particular for clarifying the igniting powder strip utilized for enhancing or boosting the internal igniting coating.
Figure 3:
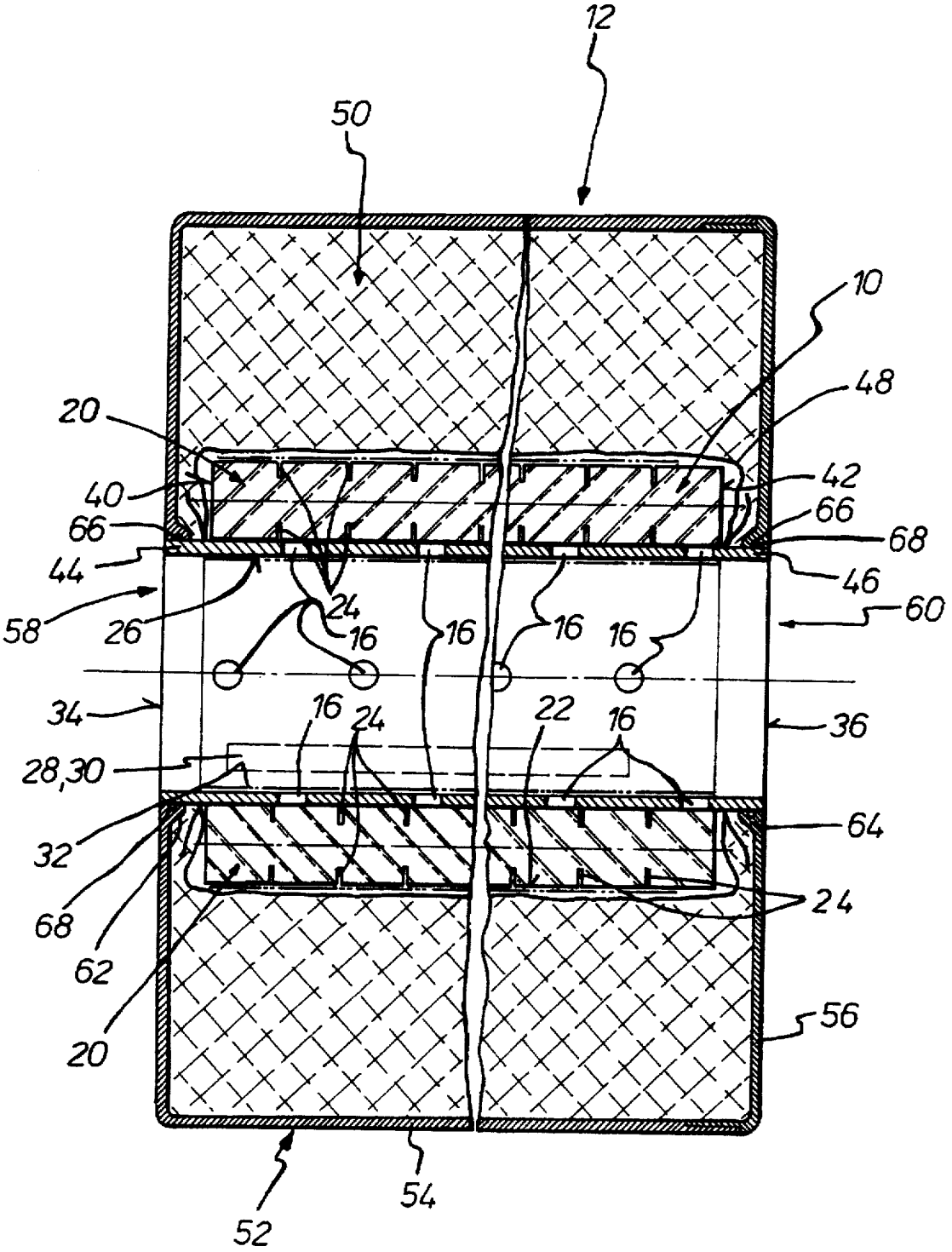
FIG. 3 illustrates a longitudinal sectional view through a shortened representation of a propellent charge equipped with an igniting unit according to FIG. 1.

FIG. 1 illustrates an igniting unit 10 for a propellent charge 12, as is shown in FIG. 3 in a sectional representation corresponding to FIG. 1. The igniting unit 10 possesses a central perforated flame guiding tube 14 which is constituted from a combustible material. The flame guiding tube 14 is equipped with through-apertures 16. Arranged on the external casing surface 18 of the flame guiding tube 14 are closely adjoining propellant rods 20 as detailed in large scale view in FIG. 2, which are oriented to extend along the axial direction of the flame guiding tube 14 or; in essence, along the igniting unit 10. The propellant rods 20 are provided about their outer casing surfaces 22 with mutually spaced cut-ins or recesses 24 which are oriented in mutually parallel radial planes and which, expediently, are located diametrically opposite each other.

Fixed on the internal casing surface 26 of the perforated flame guiding tube 14, by means of an adhesive 28, the latter of which may be an adhesive based on nitrocellulose, is an igniting powder strip 30, in effect, which is prefixed in position, and which may be a constituted from a black powder strip. The final positioning of the igniting powder strip 30 is effected by means of an igniting coating 32 which is subsequently to be applied or attached to the internal casing surface 26 of the flame guiding tube 14, as can be clearly ascertained from FIG. 2 of the drawings. From FIG. 1 there can be ascertained that the last-mentioned igniting coating 32 is set back or recessed relative to the two annular end surfaces 34 and 36 of the flame guiding tube 14. A second igniting coating 38 is provided on the exterior of the igniting unit 10. This igniting coating 38 covers the casing or outer surfaces 22 of the propellant rods 20, whereby the end surfaces 40 and 42 of the propellant rods 20 remain exposed or free from the igniting coating 38.

From FIG. 1 there can be ascertained that the propellant rods 20 are shorter in length than the flame guiding tube 14. The propellant rods 20 are arranged on the external casing surface 18 of the flame guiding tube 14 in such a manner that the flame guiding tube 14 has a forward end portion 44 projecting beyond the therewith associated forward end surfaces 40 of the propellant rods 20, and has a rearward end portion 46 project beyond the rearward end surfaces 42 of the propellant rods 20. The propellant rods 20 are encompassed by a covering 48 which is positioned in close contact with the two end portions 44 and 46 of the flame guiding tube 14. The covering 48, which can be constructed; for example, from a fabric bag or from a cotton material, in particular at the beginning of the igniting process of the igniting unit 10, is ascribed an essential function; in effect, the affording of a uniform igniting. Moreover, through the utilization of the mentioned covering 48, there is obtained a mechanical protection for the igniting unit 10 with regard to the pourable charging 50 of the propellent charge 12 or, respectively, of the propellant module which encompasses the igniting unit 10, as is represented in FIG. 3. In FIG. 3 the same details are identified by the same reference numerals as those in FIG. 1 so that, in connection with FIG. 3, it is unnecessary to again describe all of these elements in specific detail. FIG. 3 further clarifies the employment of a two-part propellant housing 52, whereby the two housing parts 54 and 56 are closely or sealingly connected with each other and are each respectively formed with an aperture 58 or 60 at the bottom end, between which there extends the igniting unit 10 or, respectively, the flame guiding tube 14 of the igniting unit 10. The apertures 58 and 60 in the two housing parts 54 and 56 are each formed with, respectively, a collar 62 or 64. Each collar 62, 64 is provided with an inwardly circumferential groove 66, in which a sealing ring 68 is arranged.

What is claimed is:

1. An igniting unit for a propellent charge (12), comprising a central perforated flame guiding tube (14); propellant rods (20) being arranged about an outer casing surface (18) of the flame guiding tube, said propellant rods being oriented along the axial direction of said tube; an igniting coating (32, 38) being provided on an inner casing surface (26) of said flame guiding tube (14) and on the external casing surfaces (22) of the propellant rods (20); and the igniting coating (32) located on the inner casing surface (26) of the flame guiding tube (14) being enhanced by an igniting powder strip (30) oriented to extend in the axial direction of said surface (26).

2. An igniting unit as claimed in claim 1, wherein the igniting powder strip (30) is constituted of a black powder strip.

3. An igniting unit as claimed in claim 1, wherein an adhesive (28) fastens the igniting powder strip (30) to the inner casing surface (26) of the flame guiding tube (14).

4. An igniting unit as claimed in claim 3, wherein the adhesive (28) is constituted of an adhesive which is based on nitrocellulose.

5. An igniting unit as claimed in claim 1, wherein the igniting powder strip (30) is covered by the igniting coating (32) which is located on the inner casing surface (26) of the flame guiding tube (14).

6. An igniting unit as claimed in claim 1, wherein the propellant rods (20) have a shorter axial length than that of the flame guiding tube (14), said propellant rods (20) being arranged on the flame guiding tube (14) such that the flame guiding tube has forward and rearward end portions (44, 46) each projecting beyond end surfaces (40, 42) of the propellant rods (20), and a covering (48) encompassing the propellant rods (20) and closely contacting the end portions (44, 46) of the flame guiding tube (14).

7. An igniting unit as claimed in claim 6, wherein the covering (48) is constituted from a fabric bag or cotton material.

8. An igniting unit as claimed in claim 1, wherein the propellant rods (20) have mutually spaced recesses (24) formed along the casing surfaces (22), said recesses (24) being oriented to extend in radial planes.

9. An igniting unit as claimed in claim 8, wherein said recesses (24) are located diametrically opposite each other.

* * * * *